US006596676B1

(12) United States Patent
Prochilo

(10) Patent No.: US 6,596,676 B1
(45) Date of Patent: Jul. 22, 2003

(54) PROTECTIVE COMPOSITION AND METHOD FOR OVENS

(76) Inventor: Robert Prochilo, 2878 Grand Ave., Baldwin, NY (US) 11510

( * ) Notice: Subject to any disclaimer, the term of this patent is extended or adjusted under 35 U.S.C. 154(b) by 0 days.

(21) Appl. No.: 10/299,254

(22) Filed: Nov. 18, 2002

(51) Int. Cl.[7] ..... C11D 3/08

(52) U.S. Cl. ..... 510/197; 510/245; 510/254; 510/507; 510/511

(58) Field of Search ..... 510/197, 245, 510/254, 511, 507

(56) References Cited

U.S. PATENT DOCUMENTS 4,504,717 A * 3/1985 Arai ..... 219/10.55 E

* cited by examiner

*Primary Examiner*—Charles Boyer
(74) *Attorney, Agent, or Firm*—Michael G. Petit

(57) ABSTRACT

A colloidal composition for application to the walls of a clean, warm oven and accessories contained therein to prevent the adherence of carbon-based residues thereto. The composition is shaken to disburse the colloidal particles, then applied to the clean, warm (~140° F.) surface of the oven walls with an applicator such as a brush or sponge and the oven is ready for use. After a coating of carbonized residue has accumulated on the composition-coated surface, both the residue and the composition are easily removed with a mild detergent solution using a sponge or towel. The composition is nontoxic, environmentally safe and its use does not expose the user to harsh chemicals or fumes. In a preferred embodiment, the colloidal composition is provided in a container having a removable lid with a fine-bristled nylon applicator brush affixed thereto.

6 Claims, 2 Drawing Sheets

PROTECTIVE COMPOSITION AND METHOD FOR OVENS

BACKGROUND OF THE INVENTION

1. Field of the Invention

The present invention relates to an oven cleaner and, more particularly, to a composition for applying to the clean walls of an oven, the composition thereafter being operable for facilitating the removal of residue subsequently deposited on the oven wall.

2. Prior Art

It is well known that after extended periods of use, carbonized residue accumulates on the wall of kitchen ovens. To remove the residue, several approaches have been developed; two of which methods are widely used. In the first method, disclosed, for example, in U.S. Pat. No. 4,372,788 to Lancz, and U.S. Pat. No. 5,204,016 to Hamilton et al., a coating comprising harsh chemicals is applied to the outer surface of the residue. After a period of time that varies with the composition used, the residue is at least partially released from the oven wall and may be removed with scrubbing. This method exposes the user to harsh chemicals and fumes and requires considerable effort to remove the treated residue.

In a second method, employed in "self-cleaning" ovens, the residue is essentially incinerated in situ and the gaseous product is vented to the outdoors.

This method, although generally regarded as an improvement over the first method described above, requires a more costly oven and further requires that the oven be inoperable for cooking during the cleaning cycle.

In a third method, disclosed in U.S. Pat. No. 4,005,030 to Heckert et al., the inventors teach that a detergent composition containing an anionic detergent and an organosilane is capable of imparting soil release benefits to hard surfaces washed therewith. When a very thin layer of a compound possessing soil release benefits is applied to metallic and vitreous surfaces by a detergent composition, a thin semi-permanent coating of a compound is laid down. The amount of coating is sufficient to provide a soil release benefit to the surface, while at the same time, is neither visible nor expensive. The Heckert et al. coating comprises detergent compositions containing an anionic detergent and an organosilane which is able to provide soil release benefits to metallic and vitreous surfaces when applied thereto from a wash or rinse solution. The detergent compositions of Heckert et al. contain an organosilane and a water-soluble anionic detergent in a ratio of organosilane to anionic detergent of from 1:1 to 1:10,000, preferably 1:1 to 1:500, most preferably 1:3 to 1:60. Most detergents, however, produce objectionable odors when heated that may affect the taste of food cooked in the oven. Accordingly, there remains a need for a composition that may be used to coat the surface of an oven, thereafter to serve as a release for residue deposited thereon, which is stable, nontoxic and odorless.

SUMMARY

It is an object of the invention to provide a composition for coating the clean, interior surface of an oven, the coating thus applied thereafter providing a releasing film from which residues deposited thereon, together with the releasing film, may be easily removed.

It is a further object of the invention to provide a composition meeting the above objective that is nontoxic and thermally stable.

The features of the invention believed to be novel are set forth with particularity in the appended claims. However the invention itself, both as to organization and method of operation, together with further objects and advantages thereof may be best understood by reference to the following description taken in conjunction with the accompanying drawings.

DESCRIPTION OF THE PREFERRED EMBODIMENTS

Figure 1:
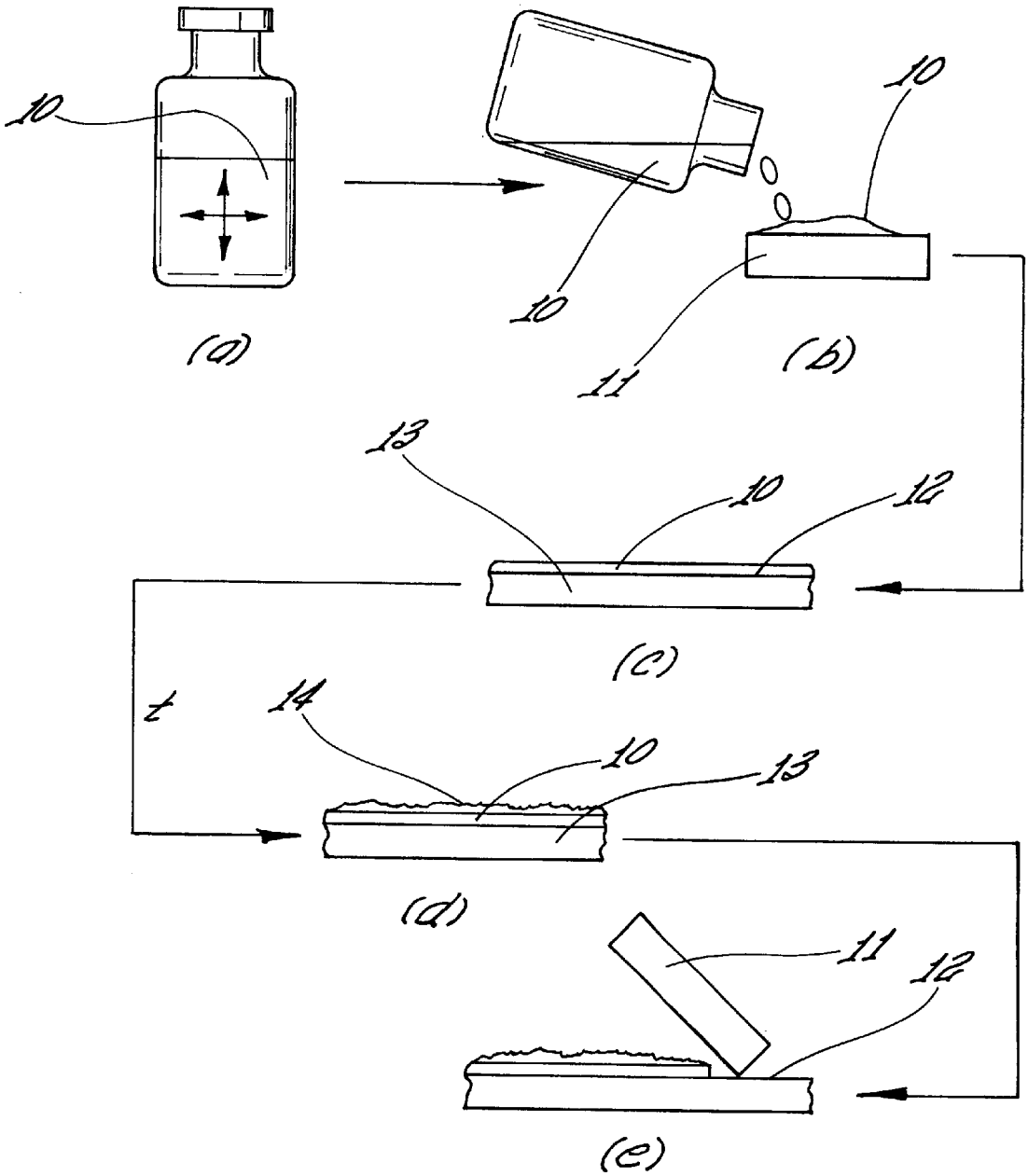
FIG. 1 is a schematic diagram showing the composition used to provide a protective film on the inner surface of an oven in order to prevent the deposition of residues thereon, and the removal of both the protective film and accumulated residues from the oven surface.

Turning now to FIG. 1(*a*), a composition 10 comprised essentially of a colloidal suspension of low density silica ($SiO_2$), Bentonite and sodium chloride in water, is shaken, as indicated by the crossed double-headed arrows, to suspend the silica and Bentonite particles. The shaken composition 10 is then transferred to a sponge 11 as shown in FIG. 1(*b*), or more preferably, to a fine-bristled nylon brush (not shown), and applied to the warm (~140° F.) surface 12 of a clean oven wall 13 to form a film 10 thereon as illustrated in FIG. 1(*c*). After a period of oven use, a coating of residue 14 accumulates on the film 10 as shown in FIG. 1(*d*). Both the film 10 and residue 14 are easily removed from the surface 12 with a wet sponge 11 and mild detergent as shown in FIG. 1(*e*).

The surface 12 of the oven is preferably vitreous to reduce corrosion of the surface by the salt. Surprisingly, the composition 10 readily adheres to the surface 12 when the surface is warmed to about 140° F. A preferred composition comprises essentially water, Bentonite, silica and NaCl, preferably in the ratio 250:2:2:0.5 w/w respectively. The silica is preferably supplied as a fine powder having a high surface area to weight ratio.

Figure 2:
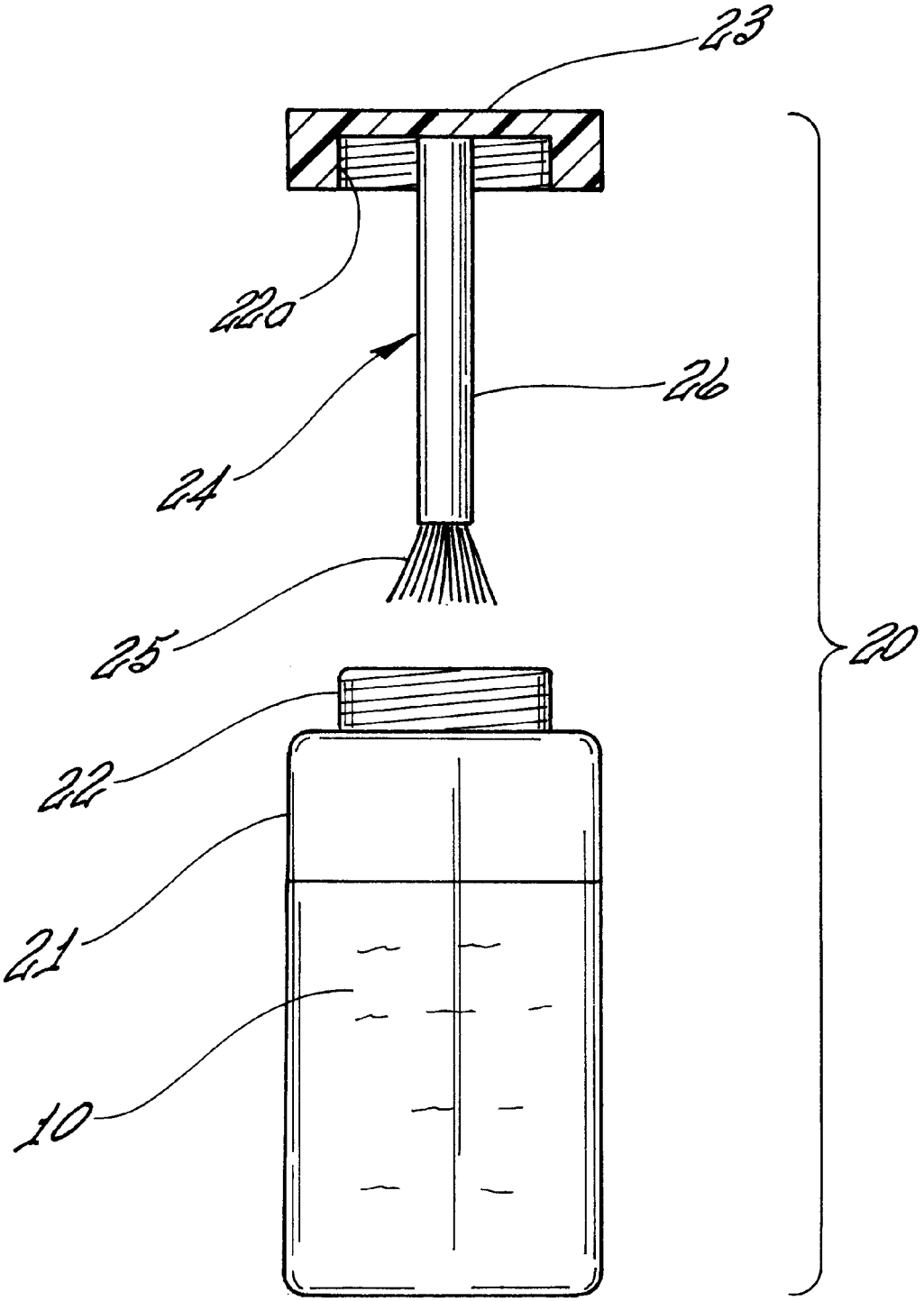
FIG. 2 is a partially cross-sectional side view of a dispenser for storing and applying the oven cleaning composition of the present invention to the clean, warm surface of an oven.

With reference to FIG. 2, a preferred dispenser for the composition 10 is indicated at numeral 20. The dispenser 20, illustrated in a partially cross-sectional side view, includes a container 21 having a threaded neck 22. A lid or cap 23 having a mating thread 22*a* thereon has a brush 24 affixed thereto. The brush 24 has a plurality of bristles 25, preferably nylon, affixed to the free end of a stem 26. In order to apply the composition 10 to the clean, warm surface of an oven, the dispenser 20 is shaken to suspend the colloidal particles and the lid 23 removed from the container 21. The brush 24 provides convenient means for applying a releasing film of composition 10 to the surface of the oven.

While particular embodiments of the present invention have been illustrated and described, it would be obvious to those skilled in the art that various other changes and modifications can be made without departing from the spirit and scope of the invention. For example, the relative proportions of silica and Bentonite in the composition may vary considerably from the preferred ratio of 1:1 provided that the total particulates (silica plus Bentonite) in the composition is about 4:250 w/w. It is therefore intended to cover in the appended claims all such changes and modifications that are within the scope of this invention.

What I claim is:

1. An oven cleaning composition for applying to a surface of an oven, said composition thereafter forming a releasing film on said surface, comprising Bentonite and silica in a saline solution.

2. The composition of claim 1 comprising 250 grams of water, 1–5 grams silica, 1–5 grams Bentonite and 0.5–1.0 grams of NaCl.

3. The composition for applying to a surface of an oven in accordance with claim 1, comprising 250 grams of water, 2 grams silica, 2 grams Bentonite and 0.5 grams of NaCl.

4. A method for cleaning an oven comprising the steps of:

(a) presenting a composition in accordance with claim 2; then (b) applying a thin layer of said composition onto a clean, warm inner surface of said oven; then (c) using the oven until a residue is deposited on said thin layer of said composition; then (d) removing the residue and thin layer of composition from the surface of the oven with a damp sponge.

5. A method for cleaning an oven comprising the steps of:

(a) presenting a composition in accordance with claim 3; then (b) applying a thin layer of said composition onto a clean, warm inner surface of said oven; then (c) using the oven until a residue is deposited on said thin layer of said composition; then (d) removing the residue and thin layer of composition from the surface of the oven with a damp sponge.

6. The composition of claim 2 wherein said composition is housed within a dispenser comprising a container having a threaded lid, said threaded lid having a brush affixed thereto.

* * * * *